US005978629A

United States Patent [19]

Stover

[11] Patent Number: 5,978,629

[45] Date of Patent: Nov. 2, 1999

[54] AC RECHARGE APPARATUS AND METHOD FOR ELECTROSTATIC PRINTING SYSTEMS USING LIQUID DEVELOPMENT

[75] Inventor: Raymond W. Stover, Webster, N.Y.

[73] Assignee: Xerox Corporation, Stamford, Conn.

[21] Appl. No.: 09/232,638

[22] Filed: Jan. 19, 1999

[51] Int. Cl.[6] ..... G03G 15/10

[52] U.S. Cl. ..... 399/237; 399/296

[58] Field of Search ..... 399/237, 222, 399/223, 228, 231, 233, 234, 235, 296

[56] References Cited

U.S. PATENT DOCUMENTS

| | | | |
|---|---|---|---|
| 5,276,492 | 1/1994 | Landa et al. | 399/249 |
| 5,576,824 | 11/1996 | Folkins | 399/228 |
| 5,600,430 | 2/1997 | Folkins et al. | 399/171 |
| 5,613,174 | 3/1997 | Denton et al. | 399/98 |
| 5,848,337 | 12/1998 | Liu et al. | 399/231 |

*Primary Examiner*—William Royer
*Assistant Examiner*—Hoan Tran
*Attorney, Agent, or Firm*—Oliff & Berridge, PLC

[57] ABSTRACT

An AC recharging device is provided for recharging a photoreceptor in a liquid xerography system in preparation for generating and developing another electrostatic latent image on the photoreceptor. The AC recharging device is useful for all types of liquid developing systems that generate two or more toner images on a photoreceptor, including image-next-to-image, image-on-image, highlight and other types of systems. A method is also provided for recharging a support having a liquid developed image in preparation for generating and developing a second electrostatic image on the support.

14 Claims, 2 Drawing Sheets

AC RECHARGE APPARATUS AND METHOD FOR ELECTROSTATIC PRINTING SYSTEMS USING LIQUID DEVELOPMENT

BACKGROUND OF THE INVENTION

1. Field of Invention

The invention relates to a recharge apparatus and method for liquid developing electrostatic printing systems. In particular, the invention relates to recharge of a photoreceptor having at least one toner image formed on its surface for subsequent exposure and development of another toner image on the photoreceptor.

2. Description of Related Art

Electrostatographic printing is well known and commonly used for copying or printing documents on a paper substrate. Electrostatographic printing is performed by forming a substantially uniform charge on a photoconductive member and exposing the photoconductive member to a pattern of light. Exposing the photoconductive member to the pattern of light generates a corresponding electrostatic latent image on the photoconductive member. Toner particles are then deposited onto the photoconductive member so that the toner particles are selectively deposited in either charged or discharged areas on the photoconductive member. The developed toner image is then typically transferred to a substrate and fixed to the substrate by heat and/or pressure. The photoreceptor is then cleaned of any residual toner or electric charge in preparation for another charge/electrostatic latent image generating/development process.

Electrostatographic printing systems typically develop an electrostatic latent image using toner particles either in powder form or suspended in a liquid carrier. In liquid developing systems, the liquid developer typically has about two percent by weight toner material distributed in the liquid carrier. An electrostatic latent image is developed by applying the liquid developer to the photoconductive member, whereby the toner particles are selectively attracted to the surface of the photoconductive member in accordance with an electrostatic latent image. Typically, the toner image on the photoconductive member immediately after development contains about 12% by weight particulate toner.

Some liquid developing systems perform an image-on-image (IOI) process in which successive layers of toner are built up on a photoreceptor to create a process color image. Therefore, in an IOI process, after a first toner layer is formed on the photoreceptor, the photoreceptor typically must be recharged and exposed before a next toner layer can be deposited on the photoreceptor. One process for recharging a photoreceptor is a "split recharge" process, in which a first charging device overcharges the photoreceptor and a second charging device applies a charge of opposite polarity to the photoreceptor to reduce the level of charge on the photoreceptor. A split recharge system for a powder developing system is described in U.S. Pat. No. 5,600,430 to Folkins et al., which is incorporated herein by reference in its entirety. As described in U.S. Pat. No. 5,600,430, a first charging device, such as a corona charging device, overcharges the photoreceptor to a level higher than a desired voltage level for exposure. A second charging device applies a charge of opposite potential to the photoreceptor to reduce the charge level on the photoreceptor to a desired pre-exposure level.

SUMMARY OF THE INVENTION

The invention provides a recharge device for a liquid developing printing system that recharges a photoreceptor that has at least one developed toner image on its surface. The recharge device applies an AC signal to the photoreceptor to reduce charge in the developed toner layer(s) and recharge the photoreceptor.

In one aspect of the invention, the recharge device operates as a first stage in a two stage recharge process.

In one aspect of the invention, the recharge device recharges a photoreceptor alone without a second charging device. That is, recharging is performed in one stage.

The invention also provides a method for recharging a support having at least one developed toner image on its surface in preparation for generating a subsequent electrostatic latent image on the support. Recharging is performed by applying an AC signal to the support.

In one aspect of the invention, the support is recharged by first raising the potential of the support and then applying an AC signal to the support.

In one aspect of the invention, the photoreceptor is recharged by using an AC signal alone.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
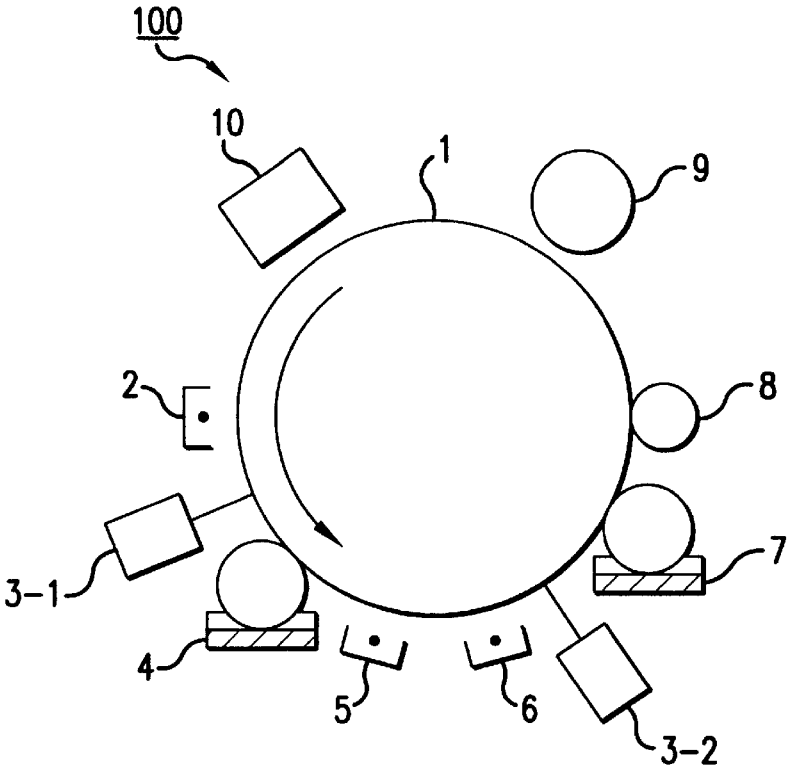
FIG. 1 is a schematic block diagram of a first embodiment of a liquid development printing system in accordance with the invention.

As discussed above, split recharge and other charging device recharge systems have been used in powder toner development electrostatographic printing systems, like that discussed in U.S. Pat. No. 5,600,430. The split recharge system described in U.S. Pat. No. 5,600,430 uses a first charging device to initially overcharge the photoreceptor and a second charging device to reduce the charge on the photoreceptor. In one embodiment disclosed in U.S. Pat. No. 5,600,430, the second charging device is an AC charging device that delivers both positive and negative ions to the photoreceptor to reduce the charge gradient across the toner layer and to neutralize the charge on the toner surface. However, a charge gradient usually exists in the toner layer because ions of a polarity opposite the toner polarity are prevented from getting into the layer by the high electric fields present. For example, positive ions are prevented from entering a negative toner layer and instead attach to the top surface of the layer, neutralizing the charge at the surface. This process reduces unwanted effects, such as undercolor splatter, that occurs when the polarity of a toner layer is reversed during recharge.

Regarding liquid developing printing systems, the inventor has discovered that conventional split recharge systems using DC charging devices are not very effective in reducing charge in liquid developed toner layers on a photoreceptor because, unlike powder toner layers, substantially all of the charge deposited on a liquid developed toner layer passes through the layer to the photoreceptor. Therefore, although problems such as undercolor splatter caused by toner polarity reversal are reduced, the tendency of a liquid developed toner layer to pass charge in this manner makes it difficult to modify the charge in the toner layer.

However, liquid developed toner layers do capture some charge deposited on them, especially charge of a polarity opposite the toner polarity. Thus, the inventor has determined that by passing more total charge, both positive and negative, through a liquid developed toner layer, charge in the layer can be reduced without overcharging the photoreceptor. One way to do this is to use an AC charging device in liquid developing printing systems to recharge a photoreceptor because it is effective for both recharging the photoreceptor and reducing the charge in liquid developed toner layers. That is, assuming that discharged area development (DAD) is performed on an initially negatively charged photoreceptor, negative ions deposited on the photoreceptor in large part pass through toner layers to the photoreceptor to charge the photoreceptor and are not readily captured by the toner, while positive ions are readily captured by the negative polarity toner. The result is that the photoreceptor is recharged while the overall charge in the toner layer(s) is reduced. In fact, split recharge, where the photoreceptor is initially overcharged, is not necessary when using the AC recharge device and method in accordance with the invention.

Figure 2:
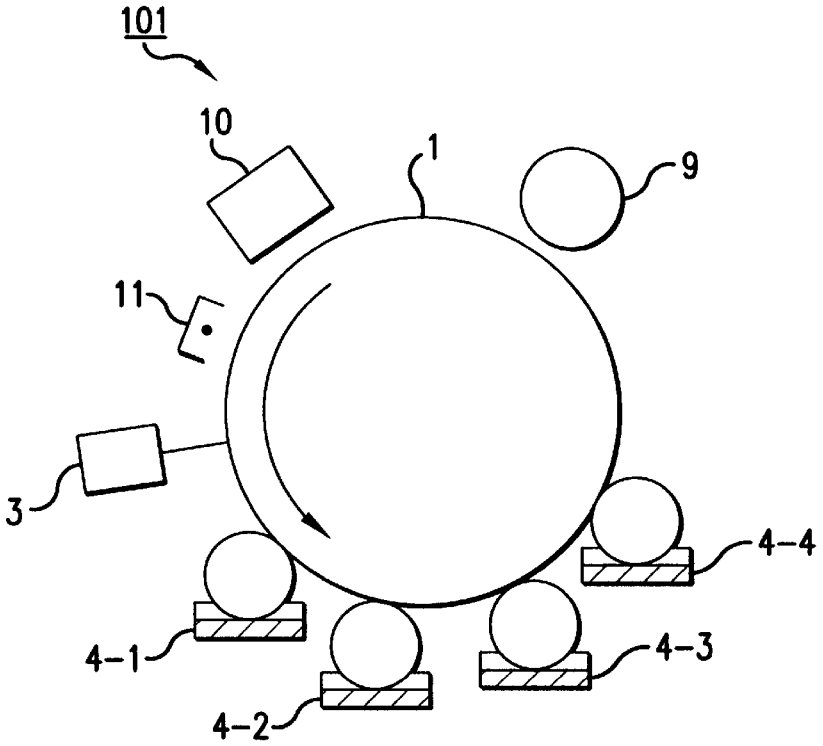
FIG. 2 is a schematic block diagram of a second embodiment of a liquid development printing system in accordance with the invention.

FIG. 1 is a schematic block diagram of a liquid developing printing apparatus 100 in accordance with the invention. The liquid developing printing apparatus 100 is only one example of the different kinds of liquid developing systems in which the invention can be used. For example, the liquid developing printing apparatus 100 includes multiple exposure devices that each form an electrostatic latent image on the photoreceptor. However, as is well known and shown in the FIG. 2 embodiment, the apparatus 100 could be modified to use only one exposure device. In addition, the apparatus 100 includes two developers, but three or more developers, as shown in FIG. 2, could be used, if desired.

The printing apparatus 100 includes a photoreceptor 1 that rotates in a counterclockwise direction. In this embodiment, the photoreceptor 1 is a solid drum, but can be formed as a flexible or inflexible belt, as is known in the art. Generally, the photoreceptor 1 includes a photoconductive material formed on a conductive substrate (not shown). The conductive substrate is typically grounded so that when a charge is distributed on the photoconductive surface and a portion of the photoreceptor 1 surface is illuminated, charge on the photoconductive surface is drained through the illuminated portion to the conductive substrate.

The photoreceptor 1 is charged by a charging device 2, which can be an AC or DC corotron, scorotron, dicoroton, pin scorotron or other charging device known in the art. The charging device 2 distributes a substantially uniform charge of either negative or positive polarity on the photoreceptor 1 surface. An exposure device 3-1 exposes the charged photoreceptor 1 surface to a desired pattern of light. Exposed portions of the photoreceptor 1 are discharged to form an electrostatic latent image on the photoreceptor 1. The exposure device 3-1 can include any known exposure devices, including an addressable laser, ROS device, a moving lens system that projects an image of a scanned document onto the photoreceptor 1, etc.

A first developer 4 applies liquid developer containing toner particles to the photoreceptor 1 surface so that toner particles are selectively deposited on the photoreceptor 1 in accordance with the electrostatic latent image formed by the exposure device 3-1. Either charged area development (CAD) or discharged area development (DAD) can be performed as desired. In charged area development, toner particles are deposited in charged areas of the photoreceptor 1. In discharged area development, toner particles are deposited on discharged areas of the photoreceptor 1. For example, if DAD is performed using a negatively charged photoreceptor 1, negatively charged toner particles in the liquid developer are deposited in discharged areas and repelled from charged areas on the photoreceptor 1. The developers 4 and 7 are shown only schematically in FIG. 1. Any known device for developing a latent image can be used, such as immersing the photoreceptor 1 in liquid developer, or applying liquid developer to the photoreceptor 1 using a roller, etc.

After the toner image is developed on the photoreceptor 1, excess liquid carrier on the photoreceptor 1 can removed by a blotter or metering roller (not shown), as is described in U.S. Pat. No. 5,276,492 to Landa et al., for example.

The embodiment shown in FIG. 1 uses a split recharge-type recharging device that includes a first recharge device 5 and a second AC recharge device 6. Similar to a split recharge method, the first recharge device 5 serves to quickly raise the voltage on the photoreceptor 1 to a desired level. The second AC recharge device 6 then passes AC current through the toner layer. Thus, the photoreceptor 1 need not be initially overcharged by the first recharge device 5. The first recharge device 5 can be any DC corotron, scorotron, dicoroton, pin scorotron or other charging device known in the art. The second AC recharge device 6 is preferably a scorotron operating in an AC mode, but can include any other suitable charging device.

Once the photoreceptor 1 is recharged, an exposure device 3-2 similar or the same as the exposure device 3-1 illuminates selected portions of the photoreceptor 1 to generate a second electrostatic latent image. The second electrostatic latent image is developed by a second developer 7, which operates similarly to the first developer 4. A blotter 8 removes excess liquid carrier from the developed toner image and adjusts the charge on the developed toner image and/or the photoreceptor 1 in preparation for transferring the toner image from the photoreceptor 1. However, the blotter 8 need not adjust the charge on the toner layer on the photoreceptor 1, if desired. An image transfer device 9 transfers the developed toner image to a substrate, such as a paper substrate or to some other surface, such as an image bearing roller or belt.

A cleaning device 10 removes any residual toner and/or charge on the photoreceptor 1 after the developed toner image is transferred by the image transfer device 9. The cleaning device 10 can include any of several different devices as is known in the art, such as a cleaning blade, roller, or other device for removing residual toner, and a lamp or other device for removing residual electric charge on the photoreceptor 1.

FIG. 2 shows a second embodiment of a liquid developing printing apparatus 101 in accordance with the invention. The printing apparatus 101 operates similarly to the printing apparatus 100 shown in FIG. 1. However, in the printing apparatus 101, only one charging device 11 and one exposure device 3 are provided. Thus, the printing apparatus 101 operates to develop multiple toner images on the photoreceptor 1 by initially charging the photoreceptor 1 using the charging device 11. An electrostatic latent image is then formed on the photoreceptor 1 by the exposure device 3. One or more developers 4-1 through 4-4 are used to develop the electrostatic latent image. The charging device 11 then recharges the photoreceptor 1 in preparation for generating a second electrostatic latent image on the photoreceptor 1 and subsequent development by one or more of the developers 4-1 through 4-4.

When the charging device 11 initially charges the photoreceptor 1, the charging device operates in a first mode, such as a DC or AC mode, to appropriately charge the photoreceptor 1. However, when the charging device 11 recharges the photoreceptor 1 after one or more toner layers is formed on the photoreceptor 1, the charging device 11 operates in an AC recharge mode so that the photoreceptor 1 is recharged and the charge in the toner layer(s) is reduced. The charging device 11 is preferably a scorotron, but can be any other suitable charging device.

The invention is useful in both discharged area development (DAD) and charged area development (CAD) processes. However, in CAD systems, the toner layer(s) on the photoreceptor 1 may be reversed in polarity during recharge. This result may be beneficial because the increased development potential improves image development, but can also cause the toner to be dislodged from the photoreceptor 1. However, AC recharging is still effective to reduce toner layer charge in both CAD and DAD processes.

Figure 3:
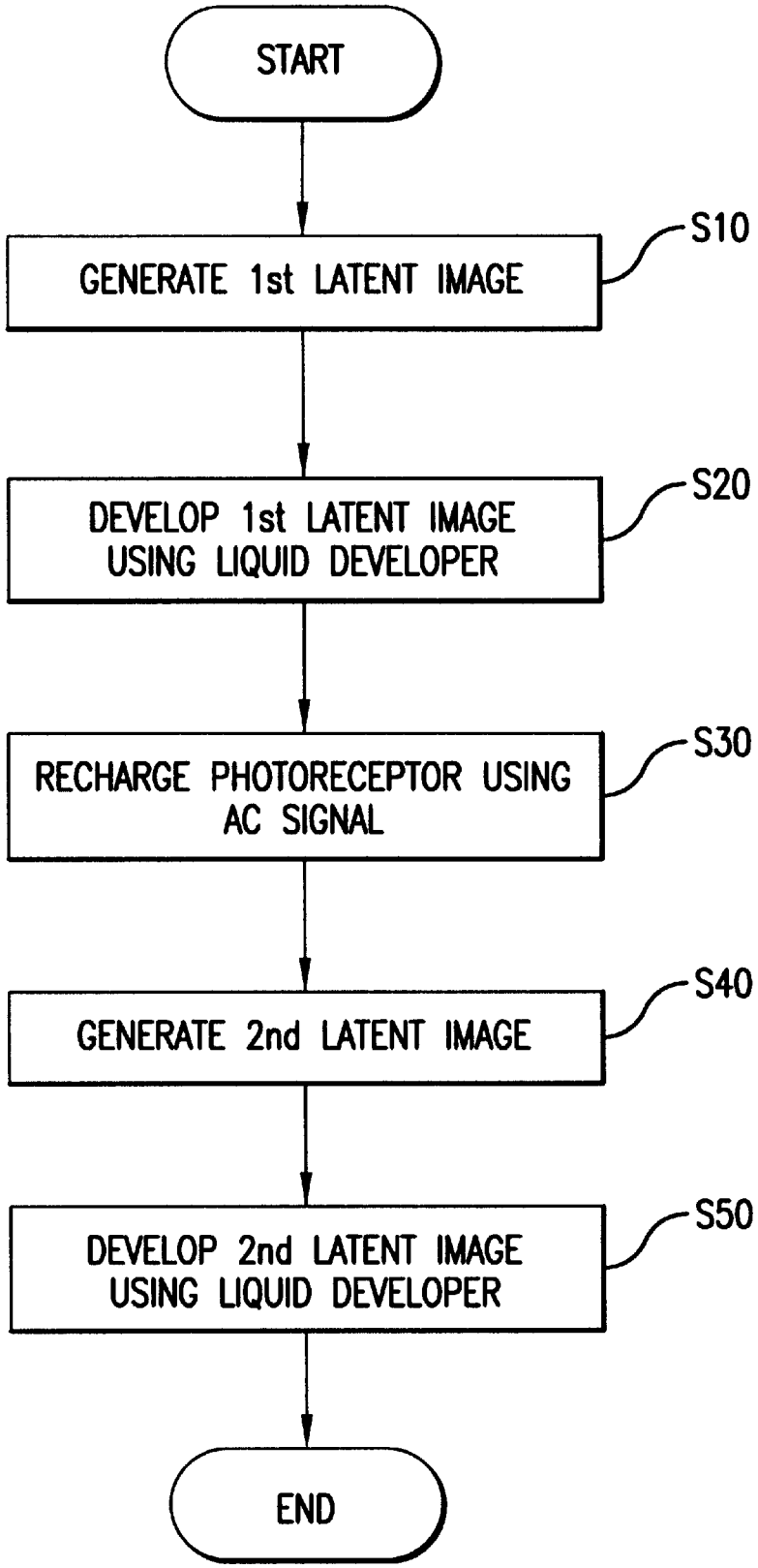
FIG. 3 is a flow diagram of a method for recharging a photoreceptor in accordance with the invention.

FIG. 3 is a flowchart of steps for recharging a photoreceptor in accordance with the invention. In step S10, a first latent image is developed on a photoreceptor. In step S20, the first latent image is developed using a liquid development technique, such as by applying a liquid developer having toner dispersed in a liquid carrier. In step S30, the photoreceptor is recharged using an AC signal. That is, an AC current is applied to the photoreceptor having a developed toner image on its surface. In step S40, a second latent image is generated on the photoreceptor. In step S50, the second latent image is developed using a liquid development technique.

Although the above embodiment is described in connection with IOI processes, the invention can be used in systems that use highlight color or image-next-to-image (INI) processes or other processes. In short, the invention is useful for recharging a photoreceptor for subsequent electrostatic latent image generation and development in any type of electrostatographic printing apparatus using liquid development.

While the invention has been described with specific embodiments, the description of the specific embodiments is illustrative only and is not to be construed as limiting the scope of the invention. Various other modifications and changes may occur to those skilled in the art without departing from the spirit and scope of the invention.

What is claimed is:

1. A printing device comprising:

a photoreceptor having a first electrostatic latent image formed on a surface of the photoreceptor;

a developer that develops the first electrostatic latent image using a liquid developing medium; and an AC charging device that applies an AC signal to the photoreceptor having a toner layer on the surface to charge the photoreceptor in preparation for generating a second electrostatic latent image on the photoreceptor.

2. The printing device of claim 1, further comprising:

a second charging device that applies a charge to the photoreceptor before the AC charging device applies the AC signal to the photoreceptor.

3. The printing device of claim 2, wherein the second charging device is a corona charging device.

4. The printing device of claim 1, wherein toner in the liquid developing medium is deposited in charged areas of the first electrostatic latent image.

5. The printing device of claim 1, wherein toner in the liquid developing medium is deposited in discharged areas of the first electrostatic latent image.

6. The printing device of claim 1, wherein the AC charging device is a scorotron.

7. A method of forming a plurality of toner images on a support, comprising:

forming an electrostatic latent image on the support;

developing the electrostatic latent image using a liquid developing medium; and applying an AC signal to the support and a toner layer on the support to charge the support to a desired level in preparation for forming another electrostatic latent image on the support.

8. The method of claim 7, further comprising:

applying a charge to the support before applying the AC signal to the support.

9. The method of claim 7, wherein the step of developing the electrostatic latent image comprises depositing toner particles in charged areas of the electrostatic latent image.

10. The method of claim 7, wherein the step of developing the electrostatic latent image comprises depositing toner particles in discharged areas of the electrostatic latent image.

11. A printing device comprising:

electrostatic image forming means for forming an electrostatic latent image on a support;

developing means for developing the electrostatic latent image on the support using a liquid developer; and signal applying means for applying an AC signal to the support and a toner layer on the support in preparation for generating another electrostatic latent image on the support.

12. The printing device of claim 11, further comprising charging means for applying a charge to the support before the AC signal is applied to the support.

13. The printing device of claim 12, wherein the charging means comprises a corona charging device.

14. The printing device of claim 11, wherein the signal applying means comprises a scorotron.

* * * * *